US005379925A

United States Patent [19]

Möthrath et al.

[11] Patent Number: 5,379,925

[45] Date of Patent: Jan. 10, 1995

[54] GLASS CARAFE FOR STORING A BREWED BEVERAGE

[75] Inventors: Georg Möthrath, Gelnhausen; Andreas Peter, Kronberg, both of Germany

[73] Assignee: Braun Aktiengesellschaft, Kronberg, Germany

[21] Appl. No.: 166,696

[22] Filed: Dec. 14, 1993

[30] Foreign Application Priority Data

Dec. 18, 1992 [DE] Germany ..... 4242987

[51] Int. Cl.[6] ..... A47G 19/14

[52] U.S. Cl. ..... 222/475.1; 222/570

[58] Field of Search ..... 222/475.1, 465.1, 570

[56] References Cited

U.S. PATENT DOCUMENTS

| | | | |
|---|---|---|---|
| 3,309,000 | 3/1967 | Haverstick | 222/570 X |
| 3,853,251 | 12/1974 | Alpern | 222/570 X |
| 4,020,968 | 5/1977 | Chiavola et al. | 222/570 X |
| 4,397,400 | 8/1983 | Walter | 222/570 X |
| 5,110,016 | 5/1992 | Heimann et al. | 222/475.1 |
| 5,111,975 | 5/1992 | Roberts | 222/475.1 |
| 5,362,254 | 12/1982 | Roth et al. | 222/570 X |

FOREIGN PATENT DOCUMENTS

| | | | |
|---|---|---|---|
| 0370400 | 11/1989 | European Pat. Off. . | |
| 0413196 | 8/1990 | European Pat. Off. . | |
| 4176079 | 10/1976 | Germany . | |
| 3220057 | 12/1983 | Germany | 222/465.1 |
| 3717772 | 5/1987 | Germany . | |
| 3926760 | 8/1989 | Germany . | |

*Primary Examiner*—Kevin P. Shaver

*Attorney, Agent, or Firm*—Fish and Richardson

[57] ABSTRACT

The invention is directed to a glass carafe (1) for storing a brewed beverage, comprising a glass vessel (2) having at its upper end (23) an opening (28) bounded by a rim (34). Affixed to the rim (34) is a plastic ring structure (30) provided with a pouring spout (39) and composed of a first (31), second (32) and third (33) ring. The third ring (33) serves as an outer boundary for the opening (28). The second ring (32) bears against the rim (34) of the glass vessel (2) from above. The first ring (31) engages from above within the opening (28) of the glass vessel (2) by resilient fastening elements (35). An annular circumferential neck (26) is formed on the glass vessel (2) below the rim (34). The fastening elements (35) resiliently engage the inside of the neck (26) from above, resting flush against the inner wall (27) in the area of the neck (26). Both the third ring (33) and the first ring (31) extend at a relative distance to the opening (28). This results in a durable firm seat of the plastic ring structure (30) on the glass vessel (2) also under the effect of frequent high temperatures.

6 Claims, 1 Drawing Sheet

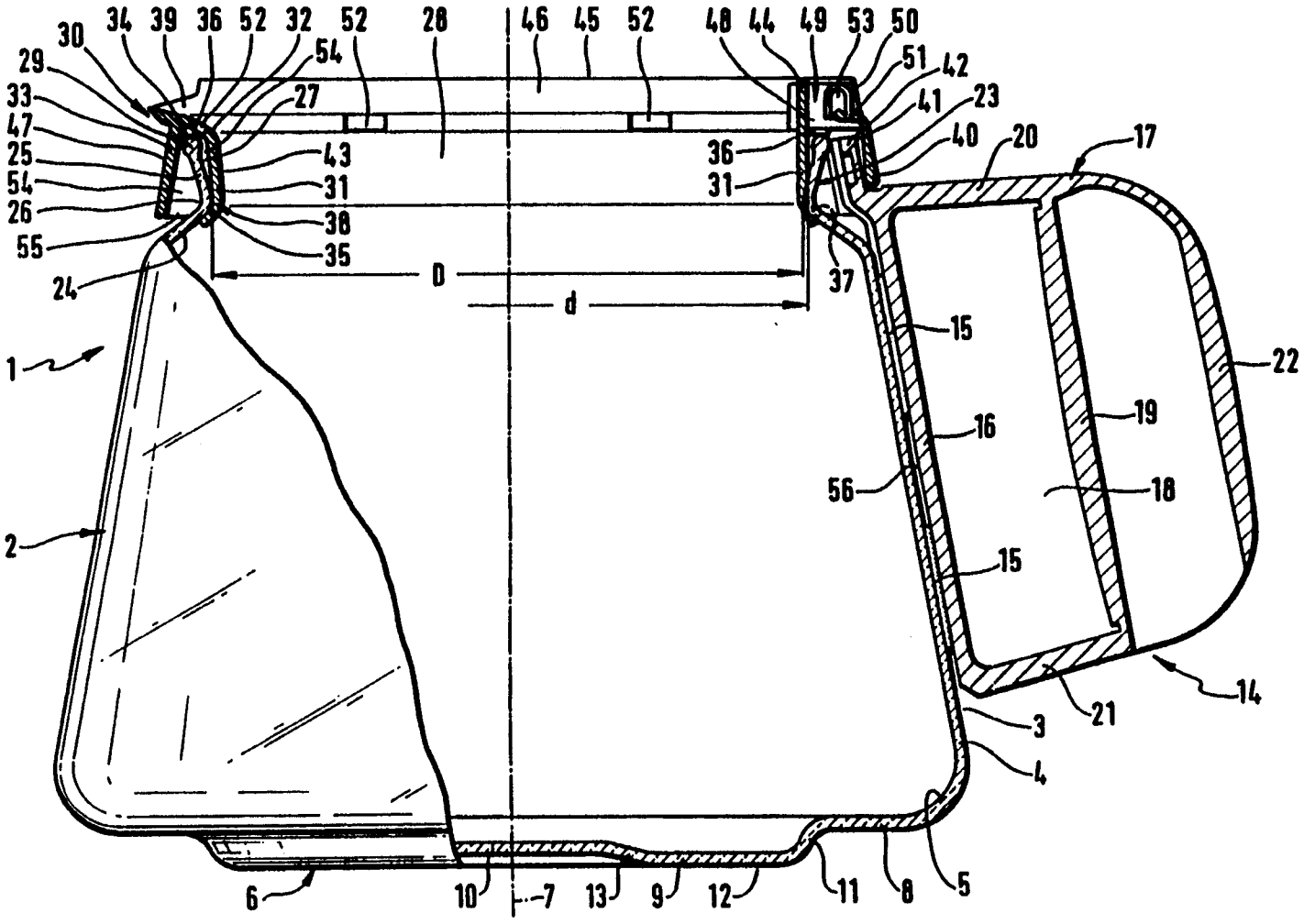
22
14
17
19
18
21
20
3
4
23
42
40
41
15
16
15
5
50
51
53
49
44
48
37
56
8
11
36
31
12
52
9
45
13
46
d
7
10
28
D
52
54
43
31
38
35
32
27
52
6
36
39
34
30
29
33
47
25
54
26
55
24
1
2

GLASS CARAFE FOR STORING A BREWED BEVERAGE

This invention relates to a glass carafe for storing a brewed beverage, comprising a hollow cylinder open at its upper end and a closed by a bottom at its lower end, the glass vessel thereof having at its upper end an opening bounded by a rim to which a plastic ring structure provided with a pouring spout is affixed, the plastic ring structure being composed of a first, second and third ring, the third ring serving as an outer boundary for the opening, the second ring bearing against the rim of the glass vessel from above, and the first ring engaging from above within the opening of the glass vessel by means of resilient fastening elements.

From EP-0 413 196 A2 a glass carafe is already known in which a plastic ring structure provided with a pouring spout is attached to the upper rim of the glass vessel. The plastic ring structure is secured to the rim of the glass vessel by adhesive bonding which is accomplished by injecting an adhesive into the annular chamber formed between the outer rim of the glass vessel and the outer ring of the plastic ring structure, the adhesive connecting the plastic ring with the glass vessel. The cost incurred by the requisite adhesive bonding being substantial, a higher selling price of the glass carafe results. Further, this type of adhesive bonding is a complex process following which particular care must be taken to prevent adhesive material from escaping in the transition areas between the plastic ring and the outer wall of the glass carafe.

From DE-39 26 760 A1 a glass carafe of the type initially referred to is known, in which the plastic ring is essentially comprised of a cylindrical wall having on its inside a circumferential groove-type recess. To mount the ring, the cylindrical wall of the plastic ring is fitted from outside over the annular bead dictated by manufacturing demands on the upper rim of the glass vessel, expanding elastically in the process until the annular bead of the glass carafe snaps into the circumferential groove-type recess in the inner wall of the plastic ring. A sealing lip provided at the upper end of the plastic ring and tapering towards its end engages from above within the opening of the glass vessel, resting against the inner wall of the upper rim of the glass vessel in sealing engagement therewith.

Whilst this known specification does not make use of a costly adhesive bonding process for connecting the plastic ring with the upper rim of the glass vessel, this snap-fitting method nevertheless involves the disadvantage that the plastic ring may work loose from the upper rim when the glass carafe is heated by hot beverages it contains. It is to be considered that hot beverages stored in the carafe heat the plastic ring by about 60° C. to 80° C., like the glass carafe in its upper rim area. Considering, however, that the thermal expansion of plastic is greater than that of glass by a factor or about 20, the plastic ring which is in thermal contact with the upper rim of the glass vessel may expand, due to progressive heating, in the area of the circumferential groove-type recess by an amount 20 times greater than does the area on the glass carafe contacting the recess. In consequence, unintentional loosening of the plastic ring from the glass carafe occurs, which effect may even be hastened by aging of the plastic material and frequent cleaning in a dishwasher.

It is therefore an object of the present invention to provide a glass carafe in which the plastic ring is prevented from becoming detached or working loose from the upper rim of the glass carafe under the effect of frequent high temperatures, not even when the glass carafe is frequently cleaned in a dishwasher where it exposed to high temperature variations. It is a further object to permit both assembly and demounting of the plastic ring on the upper rim of the glass vessel using extremely simple means, the plastic ring being also reusable on a replacement carafe in the event of breakage.

These requirements are satisfied by the present invention. By means of the present invention, the effect of temperature on the glass carafe is such that the fastening elements are elastically urged against the inner wall of the glass carafe at an increased pressure, due to the significantly greater amount of thermal expansion of the plastic ring than that of the glass vessel, the pressure being however limited so as not to break the glass carafe.

According to the present invention, the connection between the plastic ring structure and the glass vessel is simply accomplished by seating the plastic ring structure down onto the upper rim of the glass vessel by compressing the fastening elements elastically, until the fastening elements finally engage the inner wall of the rim of the glass vessel by springing back elastically, that is, spreading apart. In this arrangement, the elastically yielding fastening elements may be configured as a series of downwardly extending spring arms provided on the periphery of the plastic ring structure and resiliently engaging the inside of the neck formed on the glass vessel, wherein, however, for the purpose of providing a tight seal in the neck area of the glass vessel, the individual fastening elements continue in a closed ring biased into flush and sealing engagement with the inner wall of the neck.

According to the present invention, the plastic ring structure is centrally located on the glass vessel exclusively through its ring section providing the fastening elements, that is, since the third ring is not in engagement with the outer surface of the glass vessel, shocks acting on the third ring during the manipulation of the glass vessel are prevented from being transmitted to the glass vessel direct. This contributes significantly to preventing breakage of the glass carafe. By virtue of the rings (first and third ring) freely carried by the fastening elements, shocks acting thereon are even cushioned due to their elastic deformability, which increases the durability of the glass vessel.

A particularly even elastic bias of the fastening elements against the inner wall of the glass vessel is accomplished by other features of the present invention. In this arrangement, the circumferential first ring rests with its ring section forming the fastening elements so firmly against the inner wall of the glass vessel that an added sealing effect is obtained in the contact area, as a result of which liquids, rather than flowing through the space between the first ring and the neck of the glass vessel, are only allowed to flow over the inner wail of the first ring to the pouring spout. Therefore, the fastening elements are conformed to the inner contour of the glass carafe in the neck area. This results in an additional uniform contact pressure area to avoid glass breakage.

According to still other features of the invention, it is at all times ensured that the plastic ring structure is biased into engagement with the inner wall of the glass vessel. Since, on an increase in temperature of the glass vessel and the plastic ring structure, the latter is urged ever more firmly against the inner wall of the glass vessel due to the effect of thermal expansion, the pressure force resulting at room temperature and acting from the plastic ring structure on the inner wall of the glass vessel need not be selected so as to be particularly high. As a result, the mounting force required for fitting the plastic ring structure to the upper rim of the glass vessel is not too high either, whereby the stress to which the glass material is exposed is kept low to thus avoid glass breakage.

By means of yet other features of the invention, it is accomplished that on seating the plastic ring structure onto the upper rim of the glass vessel, it will enter the interior of the glass vessel only to a depth until the ring section formed by the fastening elements just engages the inside of the neck on the glass vessel, resiliently resting thereagainst with its surface such that the spacing means and thus the plastic ring structure are at all times biased into engagement with the upper rim of the glass vessel, without any clearance.

In a further aspect of the invention, cleaning of the space formed intermediate the upper rim of the glass vessel and the plastic ring structure is improved. By this arrangement, when the glass carafe is turned upside down which is the case when it is placed in a dishwasher, water is allowed to enter through the space formed between the third ring and the outer surface of the upper rim of the glass vessel for cleaning purposes, to be subsequently drained to the outside through the slots. The slots also prevent water from remaining in the space.

In a further aspect of the present invention, the plastic ring structure further serves as a fastening means for the handle additional to the adhesive bond, in order that the disengaging moments acting on the handle when the glass carafe is full, rather than being transmitted through the adhesive bond, are transmitted mechanically through the plastic ring structure to the upper rim of the glass vessel.

A sole embodiment of the present invention will now be described in more detail in the following with reference to the accompanying drawing showing a partial longitudinal section.

The glass carafe 1 is comprised of a vessel 2 of formed glass whose wall 4 is a hollow cylinder tapering upwardly when viewing the drawing. In downward direction, the wall 4 continues through a circumferential fillet 5 in a bottom 6 comprising two annular surfaces 8, 9 extending concentrically with a center line 7, with the smaller-diameter annular surface 9 continuing in an adjacent section 10 of circular disk shape whose center lies on the center line 7. While the annular surface 8 is recessed relative to the annular surface 9 by means of an annular shoulder 11, the outward annular surface 9 extending normal to the center line 7 provides the support surface 12 of the glass carafe 1. The circular disk shaped section 10 is equally recessed relative to the annular surface 9 through an annular step 13.

A handle 14 is provided with a fixing strip 16 for affixing it to the outer wall 3 of the glass vessel 2 by means of a single-package or two-package adhesive 15. The fixing strip 16 is integrally formed with a U-shaped bow structure 17 having in its hollow interior 18 a cross strut 19 extending substantially parallel to the fixing strip 16. The bow structure 17 is formed by two legs 20, 21 interconnected by an outer bar 22. Accordingly, an operator's hand will grasp the outer bar 22 and the cross strut 19 arranged at a relative distance thereto, thus holding the glass carafe 1 securely in one hand.

At its upper end 23, the glass vessel 2 tapers in an upwardly extending second section 24 of hollow frustoconical shape which continues in a third section 25 widening upwardly in the shape of a hollow cone, terminating at its free end with an annular bead 29. The two sections 24, 25 combine to form a neck 26, such that the diameter D formed by the inner wall 27 in the area of the neck 26 represents the smallest dimension of the opening 28 at the upper end 23 of the glass vessel 2. Accordingly, when viewed from the neck 26, the second section 24 widens in downward direction while the third section 25 widens in upward direction. The second and third section 24, 25 combine with the annular bead 29 to form the upper end 23 of the glass vessel 2.

Secured to the upper end 23 of the glass vessel 2 is a plastic ring structure 30 of substantially U-shaped cross section, comprising essentially three rings, that is, a first, second and third ring 31, 32 and 33, respectively. While the first and third ring 31, 33 form the legs of the U, the second ring 32 forms the base of the U. Extending over the rim 34 of the opening 28, the first ring 31 engages the inner wall 27 in the area of the neck 26 by means of its annular enlargement 35 provided at its free end and extending downwardly in the shape of a hollow cone, causing the spacing means 36 on the inner wall of the substantially horizontally extending second ring 32 to be biased into engagement with the upper side of the annular bead 29. The spacing means 36 are evenly spaced on the periphery of the second ring 32. The first ring 31 is of a resilient configuration, forming with its enlargement 35 the actual fastening elements of the plastic ring structure 30.

As becomes apparent from the sole Figure, the first ring 31 shown in cross section to the left of the center line 7 is illustrated in the position it will occupy following mounting of the plastic ring structure 30 on the upper end 23, abutting the inner wall 27 of the glass vessel 2 in the area of the neck 26. As becomes apparent from the drawing, the enlargement 35 provided at the free end of the first ring 31 is in such engagement with the inside of the neck 26 that a pressure force directed to the bottom 6 of the glass carafe 1 acts at all times on the plastic ring structure 30, causing its spacing means 36 to be biased into engagement with the annular bead 29, as a result of which the plastic ring structure 30 is firmly held on the glass vessel 2 without clearance.

The first ring 31 shown to the right of the center line 7 whose outer wall 37 is drawn in broken lines is illustrated as if the plastic ring structure 30 were not as yet mounted on the glass vessel 2, that is, the outside diameter d is greater than the inside diameter D at the narrowest point on the inner wall 27 of the glass vessel 2, whilst following assembly the outside diameter d corresponds to the inside diameter D in the area of the neck 26 of the glass vessel 2. The contour of the inner wall of the glass vessel 2 in the area of the neck 26 is formed by a surface curved towards the center line 7 in a convex fashion, against which the correspondingly curved area of the outer wall 37 of the first ring 31 rests snugly in the contact area 38 following assembly, as appears from the sectional view of the glass carafe 1 shown to the left of the center line 7. The enlargement 35 is elastically biased in radially inward direction by the neck 26 such as to be in clearance-free abutment with the inner wall 27 of the glass vessel 2.

Adjoining the second ring 32 is a pouring spout 39 extending approximately horizontally or at a slight upward angle, the spout being integrally formed on the plastic ring structure 30 opposite the handle 14. At an elevation above the handle 14, the third ring 33 has an enlargement 40 enclosing a recess 41 which is engaged by a hook member 42 extending from the leg 20 of the handle 14 in upward direction. By this means, the transverse forces occurring in carrying a glass carafe 1 filled with liquid are not only transmitted from the glass vessel 2 through the adhesive 15, but also from the glass vessel 2 through the plastic ring structure 30 to the hook member 42 and onwards to the handle 14.

Whilst the inner wall 43 of the first and second ring 31, 32 extends circumferentially up to the elevation of the handle 14, it is formed by a vertically upwardly extending wall section 44 in the area of the handle 14, terminating approximately at the upper edge 45 of a fourth ring 46 which, except in the area of the pouring spout 39 and the enlargement 40, provides an extension of the outer surface 47 of the third ring 33, thus forming an upwardly tapering, conical circumferential surface.

The wall section 44 has its sides bounded by two opposed boundary walls 48, so that a recess 49 of essentially rectangular cross section results which is accessible radially outwardly through an opening 50 provided on the fourth ring 46. An elbow structure 51 integrally formed with the third ring 33 and configured as a resilient locking element extends into the opening 50 in order to be able to lock in an open, vertical position a lid (not shown) adapted to be anchored in swivelling fashion within elongate grooves 53 in the boundary walls 48, in order to enable liquid to be poured in the glass carafe 1 through the opening 28 readily, without the lid shutting down all the time.

On the second ring 32 circumferentially spaced slots 52 are provided, establishing a connection between the opening 28 and the interior space 54 formed by the respective inner walls of the rings 31, 32 and 33. The interior space 54 is open in downward direction through an annular channel 55 formed by the free end of the third ring 33 and the second section 24 of the glass vessel 2.

The assembly of the glass carafe of the present invention is as follows:

First, an adhesive 15 is applied to the outside wall 3 of the glass vessel 2 following which, using a lateral swinging motion to approach the handle 14 to the outside wall 3 of the glass vessel 2, the end surface 56 of the fixing strip 16 will come in contact with the adhesive 15. The handle 14 is then pressed against the adhesive 15, thus establishing a firm adhesive bond between the handle 14 and the glass vessel 2.

The next step involves seating the plastic ring structure 30 down onto the upper end 23 of the glass vessel 2, which is accomplished by first locating the plastic ring structure 30 centrally on the inner wall 27 of the upper end 23 by means of its first ring 31. As this occurs, the enlargement 35 will bear against the inner wall 27 (not shown). At the same time, the hook member 42 will engage within the recess 41. As the mounting operation proceeds further, the enlargement 35 will be compressed by the inner wall 27 towards the center line 7 until it engages the inner wall 27 in the area of the neck 26. Due to the downwardly widening second section 24 of the glass vessel 2, the plastic ring structure 30 will then be pulled into the opening 28 of the glass vessel 2 under the action of the biased first ring 31, until the spacing means 34 rest with their ends against the annular bead 29. The plastic ring structure 30 is already firmly connected with the glass vessel 2, as shown in the Figure. The hook member 42 will occupy the position shown in which it is engaged within the recess 41, bearing against the outer wall 37.

By providing pins (not shown) on the lid for insertion within the opposite elongate grooves 53, the lid is already pivotally mounted on the plastic ring structure 30. In this arrangement, the resilient elbow structure 51 locks into a depression (not shown) provided on the lid, the elbow structure 51 thus holding the lid locked, maintaining it in its vertical, flipped open position. To close the opening 28 with the lid, the elbow structure 51 moves out of its engagement with the depression (not shown) in the lid, releasing the lid to enable it to swing into its closed position.

The plastic ring structure 30 seatable on the upper end 23 of the glass vessel 2 in elastically locking engagement therewith by means of the elastically yielding first ring 31 constitutes a detachable connection should the glass vessel 2 be broken, for example. In this event, the plastic ring structure 30 is removed from the broken glass vessel 2 and can be mounted on a replacement vessel in accordance with the mounting procedure described above. It is to be noted, however, that this requires that the handle 14 be already affixed to the glass vessel 2 because this operation is unlikely to be performed by an unskilled person.

We claim:

1. A glass carafe for storing a brewed beverage, comprising a glass vessel having at its upper end an opening bounded by a rim to which a plastic ring structure provided with a pouring spout is affixed, the plastic ring structure being composed of a first, second and third ring, the third ring serving as an outer boundary for the opening, the second ring bearing against the rim of the glass vessel from above, and the first ring including one or more resilient fastening elements formed at one end thereof, said first ring engaging from above within the opening of the glass vessel by means of the one or more resilient fastening elements, wherein an annular circumferential neck is formed on the glass vessel below the rim, wherein the one or more fastening elements resiliently engage the inside of the neck from above, resting flush against an inner wall in the area of the neck and arranged to bias the plastic ring structure through the opening into the neck, and wherein both the third ring and the first ring extend from the rim toward the neck when the plastic ring structure is seated down onto the rim of the glass vessel.

2. The glass carafe as claimed in claim 1 wherein the neck formed on the glass vessel has on either side thereof an adjacent frusto-conical enlargement providing a first and a second annular section, wherein the one or more fastening elements are formed by a circumferential ring section widening towards a free end in the manner of a frustum of a cone, and wherein the ring section rests flush against the first annular section.

3. The glass carafe as claimed in claim 2 wherein the one or more fastening elements forms a circumferential outer wall on the first ring, said outer wall having an outside diameter of (d) at a narrowest point thereof wherein the inner wall of the neck has an inside diameter (D) at a narrowest point thereof, and wherein, prior to seating the plastic ring structure down onto the rim of the glass vessel, the inside diameter (D) is smaller than the outside diameter (d).

4. The glass carafe as claimed in claim 1 wherein the second ring has spacing means formed on an end surface and wherein the second ring is in engagement with the rim of the glass vessel through the spacing means formed thereon.

5. The glass carafe as claimed in claim 2 wherein the three rings and the second annular section of the glass vessel form an outer annular chamber and an inner annular chamber when the plastic ring structure is seated down onto the rim of the glass vessel and wherein slots are provided on the second ring to connect the outer and inner annular chambers with atmosphere.

6. The glass carafe as claimed in claim 5 wherein a handle is affixed to the outside wall of the glass vessel by adhesive bonding, wherein a hook member is integrally formed on the handle, and wherein a recess is provided on the third ring for engagement by the hook member.

* * * * *